US008524432B2

(12) United States Patent
Nukada et al.

(10) Patent No.: US 8,524,432 B2
(45) Date of Patent: Sep. 3, 2013

(54) ELECTROPHOTOGRAPHIC PHOTORECEPTOR, PROCESS CARTRIDGE, AND IMAGE FORMING APPARATUS

(75) Inventors: Hidemi Nukada, Kanagawa (JP); Masaru Miura, Kanagawa (JP); Shinya Yamamoto, Kanagawa (JP); Isamu Ishiko, Kanagawa (JP); Tetsuya Ezumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 362 days.

(21) Appl. No.: 12/569,304

(22) Filed: Sep. 29, 2009

(65) Prior Publication Data

US 2010/0221652 A1 Sep. 2, 2010

(30) Foreign Application Priority Data

Feb. 27, 2009 (JP) ..... 2009-046193

(51) Int. Cl.
*G03G 5/147* (2006.01)
*G03G 21/16* (2006.01)
*G03G 15/04* (2006.01)

(52) U.S. Cl.
USPC ..... 430/66; 399/111; 399/159

(58) Field of Classification Search
USPC ..... 430/66; 399/111, 159
See application file for complete search history.

(56) References Cited

U.S. PATENT DOCUMENTS

| | | | |
|---|---|---|---|
| 4,792,507 A | 12/1988 | Yoshihara et al. | |
| 5,357,320 A | 10/1994 | Kashimura et al. | |
| 5,485,250 A | 1/1996 | Kashimura et al. | |
| 6,030,736 A | 2/2000 | Ikegami et al. | |
| 6,664,014 B1 | 12/2003 | Kikuchi et al. | |
| 2005/0026058 A1 | 2/2005 | Kami et al. | |
| 2007/0292780 A1 | 12/2007 | Nagai et al. | |
| 2009/0226208 A1 * | 9/2009 | Nukada et al. | 399/111 |

FOREIGN PATENT DOCUMENTS

| | | |
|---|---|---|
| CN | 1094168 A | 10/1994 |
| CN | 1196506 A | 10/1998 |
| JP | A-63-221355 | 9/1988 |
| JP | A-6-208239 | 7/1994 |
| JP | A-6-230591 | 8/1994 |
| JP | A-6-332217 | 12/1994 |
| JP | A-10-97122 | 4/1998 |
| JP | 2000-275889 | * 10/2000 |
| JP | A-2005-62830 | 3/2005 |
| JP | A-2006-184745 | 7/2006 |

OTHER PUBLICATIONS

Japanese Office Action mailed Dec. 14, 2010 issued in Japanese Patent Application No. 2009-046193 (with translation).

(Continued)

*Primary Examiner* — Jonathan Jelsma

(74) *Attorney, Agent, or Firm* — Oliff & Berridge, PLC

(57) ABSTRACT

An electrophotographic photoreceptor includes a conductive substrate, and at least a photosensitive layer on the conductive substrate, a layer located at a surface of the photosensitive layer side of the electrophotographic photoreceptor contains fluorine containing resin particles and a fluoro graft polymer having a fluoroalkyl group having 1 to 7 carbon atoms, and an area for a polystyrene equivalent molecular weight of 700,000 or more is from about 5% to about 20% of the total area in a gel permeation chromatography (GPC) chart for the fluoro graft polymer.

9 Claims, 4 Drawing Sheets

(56) References Cited

OTHER PUBLICATIONS

First Notification of Office Action dated Mar. 22, 2011 in Chinese Patent Application No. 200810178778.6 (with translation).

U.S. Office Action dated Sep. 30, 2011 in U.S. Appl. No. 12/246,912.

U.S. Appl. No. 12/246,912, filed Oct. 7, 2008 in the name of Hidemi Nukada et al.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2009-046193 filed Feb. 27, 2009.

BACKGROUND

1. Technical Field

The present invention relates to an electrophotographic photoreceptor, a process cartridge, and an image forming apparatus.

2. Related Art

Electrophotographic image formation, having advantages of high speed operation and high printing quality, has been utilized widely, for example, in the field of copiers and laser printers. As electrophotographic photoreceptors used for electrophotographic image forming apparatus (hereinafter sometimes referred to as "photoreceptor"), electrophotographic photoreceptors using organic photoconductive materials which are inexpensive and excellent in view of productivity and disposability when compared with photoreceptors using inorganic photoconductive materials are predominant. Among them, a function separate type multilayer organic photoreceptor having a charge generating layer for generating charges by light exposure and a charge transporting layer for transporting charges is excellent in view of electrophotographic property, and various proposals have been made therefor, and put into practical use.

Methods of improving the durability of a photosensitive layer have been investigated so far and there have been proposed, for example, a method of decreasing the surface energy on the surface layer of the photoreceptor by dispersing fluorine containing resin particles in the surface layer and a method of decreasing the surface energy of the photoreceptor by coating zinc stearate or the like to the surface of the photoreceptor.

SUMMARY

According to an aspect of the invention, there is provided an electrophotographic photoreceptor including a conductive substrate, and at least a photosensitive layer on the conductive substrate, a layer located at a surface of the photosensitive layer side of the electrophotographic photoreceptor containing fluorine containing resin particles and a fluoro graft polymer having a fluoroalkyl group having 1 to 7 carbon atoms, and an area for a polystyrene equivalent molecular weight of 700,000 or more being from about 5% to about 20% of the total area in a gel permeation chromatography (GPC) chart for the fluoro graft polymer.

BRIEF DESCRIPTION OF THE DRAWINGS

Exemplary embodiments of the present invention will be described in detail based on the following figures, wherein.

DETAILED DESCRIPTION

Figure 1:
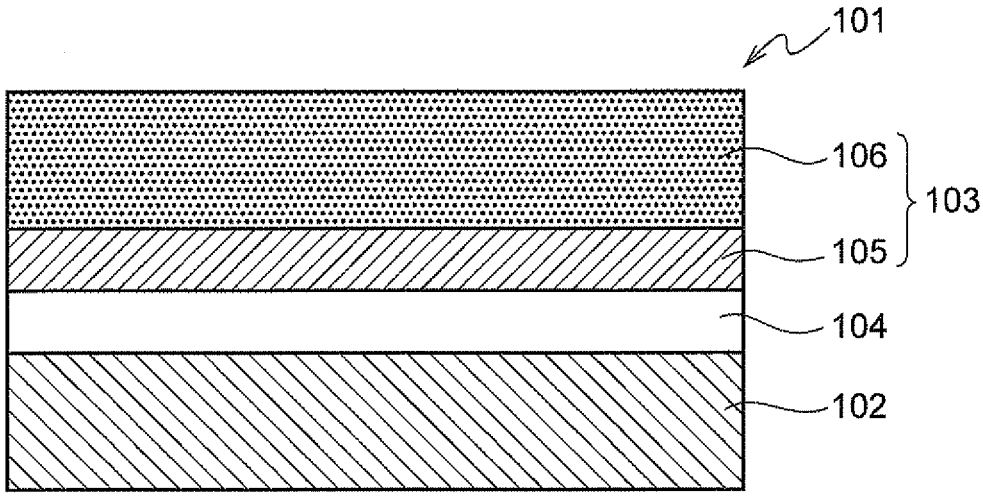
FIG. 1 is a schematic cross sectional view showing an example of an electrophotographic photoreceptor according to the exemplary embodiment.

The present invention is to be described specifically by way of embodiments of an electrophotographic photoreceptor, a process cartridge, and an image forming apparatus.

<Electrophotographic Photoreceptor>

An electrophotographic photoreceptor according to the exemplary embodiment has at least a photosensitive layer on a conductive substrate, in which a layer located at a surface of the photosensitive layer side of the electrophotographic photoreceptor (hereinafter sometimes referred to as a surface layer) contains fluorine containing resin particles and a fluoro graft polymer having a fluoroalkyl group having 1 to 7 carbon atoms (hereinafter sometimes referred to as a fluoro graft polymer according to the exemplary embodiment), and an area for a polystyrene equivalent molecular weight of 700,000 or more is from 5% (or about 5%) to 20% (or about 20%) of the total area in a gel permeation chromatography (GPC) chart for the fluoro graft polymer.

"Conductive" means herein that a volume resistivity is less than $10^7 \Omega \cdot cm$.

In the exemplary embodiment, a gel permeation chromatography measurement is carried out by using "HLC-8120 GPC, SC-8020 device, manufactured by Tosoh Corporation" as a gel permeation chromatograph (GPC), using two columns of "TSK gel, Super HM-H (manufactured by Tosoh Corporation, 6.0 mm ID×15 cm)", and using THF (tetrahydrofuran) as an eluent. An experiment is carried out under the conditions of a sample concentration of 0.5%, a flow rate of 0.6 ml/min, a sample injection amount of 10 and a measuring temperature of 40° C., by using an RI detector. Further, a calibration curve is prepared from 8 samples of "polystyrene standard sample TSK standard": "A-2500", "A-5000", "F-1", "F-2", "F-4", "F-10", "F-20", and "F-40" manufactured by Tosoh Corporation When compared with inorganic photoreceptors, the organic photoreceptor is generally poor in the mechanical strength, tends to cause frictional damages or abrasion due to external mechanical forces given by being in contact with a cleaning blade, a developing brush or paper, and has short working life. Further, in a system using a contact charge system which has been used in recent years in ecological point view, abrasion of the electrophotographic receptor increases greatly compared with that of the non-contact charge system with corotron, which tends to shorten the life. In a case where the durability of the photoreceptor is insufficient as described above, lowering of image density may occur due to decrease of the sensitivity, and fogging of images may occur due to lowering of the charge potential.

In a case of dispersing a fluoro resin in the surface layer for improving the durability of the photoreceptor, since fluorine containing resin particles generally have low dispersibility and high aggregating property, the fluorine containing resin particles present in the surface layer tend to be ununiform and it is difficult to obtain a sufficient effect of improving the durability, and further, ununiform particles sometime generate defects such as defects in image quality. In view of the above, a method of improving the dispersiblity of the fluorine containing resin particles by the addition of a fluoro graft polymer as a dispersion aid has been proposed.

However, also in a case of the photoreceptor using the above conventional method, abnormality in density is generated due to increase of the residual potential during continuous use, making it sometimes difficult to obtain a good image quality.

The present inventors have made a study on a fluoro graft polymer for addressing the problems described above and, as a result, have obtained a knowledge that the phenomenon of causing the lowering of density due to increase of the residual potential is attributable to that the fluoro graft polymer used as the dispersion aid for dispersing the fluorine containing resin particles forms charge traps in a case where the polymer is not adsorbed to the fluorine containing resin particles but exists in the state of mono molecules in the photoresistive layer.

More specifically, the fluoro graft polymer improves the dispersibility of the fluorine containing resin particles by adsorption to the surface of the fluorine containing resin particles. However, unadsorbed fluoro graft polymer is present in a free state in the surface layer. In a case where the free fluoro graft polymer is present in the state of a single molecule, this forms a substance that causes a trap site of accumulating charges. Accordingly, image density tends to be lowered due to the increase of the residual potential during repetitive use under higher temperature and high humidity (for example, 28° C./85% RH).

The present inventors have made a study on the molecular weight of the fluoro graft polymer and the adsorption thereof to the fluoro resin particle. As a result, it has been found that the fluoro graft polymer present in the free state in the surface layer may be decreased to suppress increase of the residual potential when an electrophotographic photoreceptor is formed, by defining the area for a polystyrene equivalent molecular weight of 700,000 or more to be from 5% to 20% (or from about 5% to about 20%) of the total area in a gel permeation chromatography (GPC) chart of the fluoro graft polymer.

An electrophotographic photoreceptor according to the exemplary embodiment is to be described specifically with reference to the drawings and a manufacturing method thereof is also described together. In the drawings, identical or corresponding portions carry same reference numerals for which duplicate descriptions are to be omitted.

FIG. 1 is a schematic cross sectional view showing an example of an electrophotographic photoreceptor according to the exemplary embodiment. An electrophotographic photoreceptor 101 shown in FIG. 1 has a function separate type photosensitive layer 103 in which a charge generating layer 105 and a charge transporting layer 106 are disposed separately and it has a structure in which an undercoating layer 104, a charge generating layer 105, and a charge transporting layer 106 are layered in this order on a conductive substrate 102. In this case, the charge transporting layer 106 is a surface layer of the photoreceptor 101 (a layer disposed at the farthest side from the substrate 102) and contains fluorine-containing resin particles and a fluoro graft polymer according to the exemplary embodiment, details of which are to be described later.

Each of the elements of the photoreceptor 101 is to be described.

For the conductive substrate 102, any material may be used such as those conventionally used. Examples thereof include, for example, metals such as aluminum, nickel, chromium, and stainless steel, plastic films provided with a thin film of aluminum, titanium, nickel, chromium, stainless steel, gold, vanadium, tin oxide, indium oxide, and ITO, or paper and plastic films coated or impregnated with an electric conducting agent. The shape of the substrate 102 is not restricted to a drum shape, but may be a sheet-like or plate-like shape.

In a case of using a metal pipe as the conductive substrate 102, the surface may be used as it is in the state of a material pipe, or may be previously treated by mirror finishing grinding, etching, anodization, coarse grinding, centerless grinding, sand blast, wet homing, etc.

The undercoating layer 104 is optionally provided with an aim of preventing light reflection at the surface of the substrate 102, preventing flowing of unnecessary carriers from the substrate 102 to the photosensitive layer 103, etc. Examples of the material for the undercoating layer 104 include, for example, powders of metals such as aluminum, supper, nickel, and silver, conductive metal oxides such as antimony oxide, indium oxide, tin oxide, and zinc oxide, or conductive substances such as carbon fibers, carbon black, graphite powder dispersed into a binder resin and coated on the substrate. Further, two or more kinds of metal oxide particles may be used in admixture. Further, the resistance of the powder material may be controlled by applying a surface treatment using a coupling agent to the metal oxide particles.

As the binder resin contained in the undercoating layer 104, various resins may be used such as, for example, known polymer resin compounds such as acetal resin, for example, polyvinyl butyral, polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic acid anhydride resin, silicone resin, silicone-alkyd resin, phenol resin, phenol-formaldehyde resin, melamine resin, and urethane resin, or charge transporting resins having charge transporting groups or conductive resins such as polyaniline. Among them, resins insoluble in the coating solvent for the upper layer may be used and, particularly, phenol resin, phenol-formaldehyde resin, melamine resin, urethane resin, and epoxy resin may be used.

The ratio of the metal oxide particles and the binder resin in the undercoating layer 104 is not particularly limited and may be within such a range as capable of obtaining an intended property of an electrophotographic photoreceptor.

When the undercoating layer 104 is formed, a coating liquid formed by adding the ingredients described above to a solvent is used. Examples of the solvent includes organic solvents, for example, aromatic hydrocarbon solvents such as toluene and chlorobenzene, aliphatic alcohol solvents such as methanol, ethanol, n-propanol, iso-propanol, and n-butanol, ketone solvents such as acetone, cyclohexanone, and 2-butanone, halogenated aliphatic hydrocarbon solvents such as methylene chloride, chloroform, and ethylene chloride, cyclic or linear ether solvents such as tetrahydrofuran, dioxane, ethylene glycol, and diethyl ether, and ester solvents such as methyl acetate, ethyl acetate, and n-butyl acetate. Such solvents may be used each alone or two or more of them may be used in admixture. As the solvents used upon mixing, any solvents may be used which dissolve the binder resin in the mixed solvent.

Further, as a method of dispersing the metal oxide particles in the coating liquid for forming the undercoating layer, media dispersing machines such as ball mill, vibration ball mill, attriter, sand mill, horizontal sand mill, or medialess dispersing machines such as a stirrer, ultrasonic dispersing machine, roll mill, and high pressure homogenizer may be utilized. Further, examples of the high pressure homogenizer include those of collision type of dispersing a dispersion liquid in a high pressure state by liquid-liquid collision or liquid-wall collision, or flow-through type of dispersing the dispersion liquid in a high pressure state by flowing through a fine flow channel.

Examples of the method of coating a coating liquid for forming the undercoating layer obtained as described above on the substrate 102 include, dip coating, push-up coating, wire bar coating, spray coating, blade coating, knife coating, and curtain coating. The thickness of the undercoating layer 104 may be 15 μm or more, or from 20 μm to 50 μm. In the undercoating layer 104, resin particles may be added to the undercoating layer 104 for adjusting the surface roughness. As the resin particles, silicone resin particles, cross linked PMMA resin particles, etc. may be used.

Further, surface of the undercoating layer 104 may be polished for adjusting the surface roughness. As the polishing method, buff polishing, sand blasting, wet horning, grinding, etc. may be used.

Further, although not illustrated in the drawing, an intermediate layer may be further disposed on the undercoating layer 104 for improving the electric property, improving the image quality, improving the image quality sustainability, and improving the adhesion of the photosensitive layer. Examples of the binder resin used for the intermediate layer include polymer resin compounds, for example, acetal resins such as polyvinyl butyral, polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic acid anhydride resin, silicone resin, silicone-alkyd resin, phenol-formaldehyde resin, and melamine resin, as well as organic metal compounds containing atoms such as zirconium, titanium, aluminum, manganese, and silicon atoms. The compounds may be used each alone, or may be used as a mixture or a polycondensate of plural compounds. Among them, the organic metal compound containing zirconium or silicon is excellent in view of the performance such as low residual potential, less potential change due to circumstance, and less potential change by repetitive use.

Examples of the solvent used for forming the intermediate layer include known organic solvents, for example, aromatic hydrocarbon solvents such as toluene and chlorobenzene, aliphatic alcohol solvents such as methanol, ethanol, n-propanol, iso-propanol, and n-butanol, ketone solvents such as acetone, cyclohexanone, and 2-butanone, halogenated aliphatic hydrocarbon solvents such as methylene chloride, chloroform, and ethylene chloride, cyclic or linear ether solvents such as tetrahydrofuran, dioxane, ethylene glycol, and diethyl ether, and ester solvents such as methyl acetate, ethyl acetate, and n-butyl acetate. Further, such solvents may be used each alone or two or more of them may be used in admixture. As the solvents used upon mixing, any solvents may be used which dissolve the binder resin in the mixed solvent.

As the coating method for forming the intermediate layer, usual methods such as dip coating, push-up coating, wire bar coating, spray coating, blade coating, ring coating, knife coating, curtain coating, etc. may be used.

The intermediate layer serves to improve the coatability of the upper layer, and as an electric blocking layer. However, in a case where the film is excessively thick, electric barrier becomes strong excessively to cause desensitization or increase of potential due to repetitive use. Accordingly, in a case of forming the intermediate layer, the film thickness may be from 0.1 μm to 3 μm. Further, the intermediate layer in this case may also be used as the undercoating layer 104.

The charge generating layer 105 is formed by dispersing a charge generating material in an appropriate binder resin. For the charge generating material, phthalocyanine pigments such as non-metal phthalocyanine, chlorogallium phthalocyanine, hydroxygallium phthalocyanine, dichlorotin phthalocyanine, and titanyl phthalocyanine may be used. Particularly, phthalocyanine pigments that may be used include chlorogallium phthalocyanine crystals having intense diffraction peaks at least at 7.4°, 16.6°, 25.5°, and 28.3° of Bragg angle (2θ±0.2° to CuKα characteristic X-rays, non-metal phthalocyanine crystals having intense diffraction peaks at least at 7.7°, 9.3°, 16.9°, 17.5°, 22.4°, and 28.8° of Bragg angle (2θ±0.2° to CuKα characteristic X-rays, and hydroxygallium phthalocyanine crystals having intense diffraction peaks at least at 7.5°, 9.9°, 12.5°, 16.3°, 18.6°, 25.1° and 28.3° of Bragg angle (2θ±0.2° to CuKα characteristic X-rays, and titanyl phthalocyanine crystals having intense diffraction peaks at least at 9.6°, 24.1°, and 27.2° of Bragg angle (2θ±0.2° to CuKα characteristic X-rays. In addition, as the charge generating material, quinine pigments, perylene pigments, indigo pigments, bisbenzoimidazole pigments, anthrone pigments, and quinacrydone pigments may also be used. Further, the charge generating materials may be used each alone or two or more of them may be used in admixture.

Examples of the binder resin that may be used in the charge generating layer 105 include, for example, polycarbonate resins such as bisphenol A type or bisphenol Z type, acrylic resin, methacrylic resin, polyarylate resin, polyester resin, polyvinyl chloride resin, polystyrene resin, acrylonitrile-styrene copolymer resin, acrylonitrile-butadiene copolymer, polyvinyl acetate resin, polyvinyl formal resin, polysulfone resin, styrene-butadiene copolymer resin, vinylidene chloride-acrylonitrile copolymer resin, vinyl chloride-vinyl acetate resin, vinyl chloride-vinyl acetate-maleic acid anhydride resin, silicone resin, phenol-formaldehyde resin, polyacrylamide resin, polyamide resin, and poly-N-vinyl carbazol resin. The binder resins described above may be used each alone or two or more of them may be used in admixture. The blending ratio between the charge generating material and the binder resin may be in a range of from 10:1 to 1:10.

In the case of forming the charge generating layer 105, a coating liquid prepared by adding the ingredients described above to a solvent is used. Examples of the solvent includes, organic solvents, for example, aromatic hydrocarbon solvents such as toluene, and chlorobenzene, aliphatic alcohol solvents such as methanol, ethanol, n-propanol, iso-propanol, and n-butanol, ketone solvents such as acetone, cyclohexanone, and 2-butanone, halogenated aliphatic hydrocarbon solvents such as methylene chloride, chloroform, and ethylene chloride, cyclic or linear ether solvents such as tetrahydrofuran, dioxane, ethylene glycol, and diethyl ether, and ester solvents such as methyl acetate, ethyl acetate, and n-butyl acetate. Such solvents may be used each alone or two or more of them may be used in admixture. As the solvents used upon mixing, any solvents may be used which dissolve the binder resin in the mixed solvent.

For dispersing the charge generating material in the resin, a dispersion treatment is applied to the coating liquid. The dispersion method may utilize media dispersing machines such as ball mill, vibration ball mill, attriter, sand mill, horizontal sand mill, or medialess dispersing machines such as stirrer, ultrasonic dispersing machine, roll mill, high pressure homogenizer. Further, examples of the high pressure homogenizer include those of collision type of dispersing a dispersion liquid in a high pressure state by liquid-liquid collision or liquid-wall collision, or flow-through type of dispersing the dispersion liquid in a high pressure state by flowing through a fine flow channel.

Examples of the method of coating the coating liquid obtained as described on the undercoating layer 104 include dipping coating, push-up coating, wire bar coating, spray coating, blade coating, ring coating, knife coating, and curtain coating. The thickness of the charge generating layer 105 may be from 0.01 μm to 5 μm, or from 0.05 μm to 2.0 μm.

The charge transporting layer 106 constitutes the surface layer of the electrophotographic photoreceptor according to the exemplary embodiment. That is, the charge transporting layer 106 contains fluorine containing resin particles and a fluoro graft polymer according to the exemplary embodiment, wherein the area for a polystyrene equivalent molecular weight of 700,000 or more is from 5% to 20% (or from about 5% to about 20%) of the total area in the gel permeation chromatography (GPC) chart of the fluoro graft polymer according to the exemplary embodiment.

In a case where the area for a polystyrene equivalent molecular weight of 700,000 or more is less than 5% of the total area in the GPC chart of the fluoro graft polymer, the dispersibility of the fluorine containing resin particles is worsened and the defects of the coating film tend to increase to sometimes increase the defects of the image quality. Further, in a case where it exceeds 20%, the store stability of the coating liquid is worsened and the defects of the coating film tends to be increased due to the deterioration of the dispersion stability of the fluorine containing resin particles to sometimes increase the defects in the image quality.

The area for a molecular weight of 700,000 or more may be from 5% to 15%, or from 5% to 10% of the total area.

Figure 2:
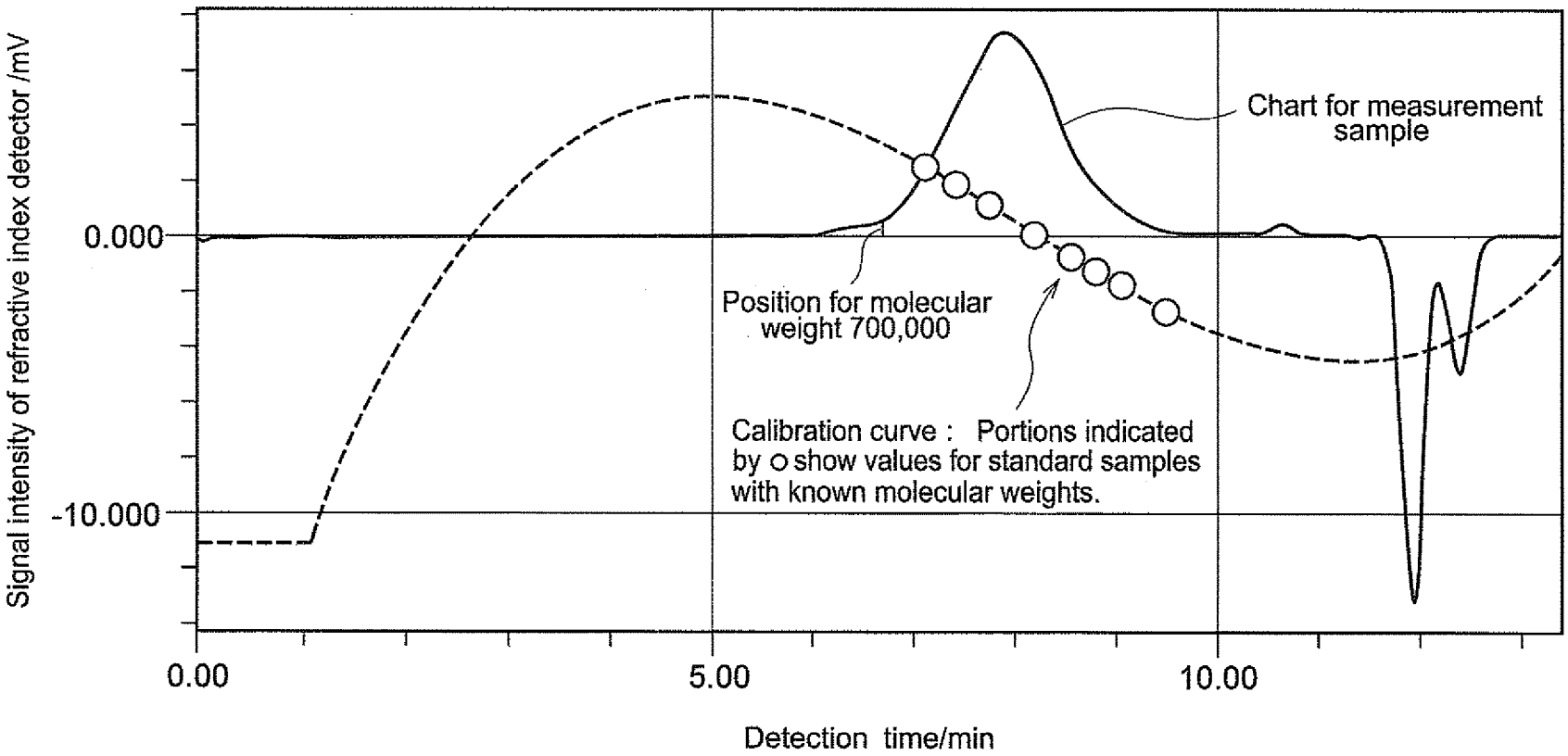
FIG. 2 is a view showing a specific example of a GPC chart of a fluoro graft polymer.

FIG. 2 shows a specific example of the GPC chart of the fluoro graft polymer according to the exemplary embodiment.

In the exemplary embodiment, the maximum peak may be present in a range where the molecular weight is from 50,000 to 150,000 (or from about 50,000 to about 150,000) in the GPC chart of the fluoro graft polymer according to the exemplary embodiment. In a case where the maximum peak is present within the molecular weight range described above, the dispersion state of the fluorine containing resin particles in the coating liquid may be stabilized to decrease unevenness of the fluorine containing resin particles when the coating liquid is coated. As a result, generating of image defects may be suppressed.

The average primary particle diameter of the fluorine containing resin particles may be from 0.05 μm to 1 μm. In a case where the average primary particle diameter of the fluorine containing resin particles is less than 0.05 μm, aggregation tends to proceed sometimes when the fluorine containing resin particles are dispersed. On the other hand, in a case where the average primary particle diameter of the fluorine containing resin particles exceeds 1 μm, the image quality defects tend to be generated sometimes. The volume average particle diameter of the fluorine containing resin particles may be from 0.1 μm to 0.5 μm.

The average primary particle diameter of the fluorine containing resin particles means a value measured by the following method.

Particles are observed by a scanning type electron microscope, and the average value for the length of the major axis of 100 particles is defined as an average primary particle diameter.

Further, the content of the fluorine containing resin particles based on the total amount of the solid content of the charge transporting layer 106 may be from 2% by weight to 15% by weight, or from 2% by weight to 12% by weight. In a case where the content of the fluorine containing resin particles based on the total amount of the solid content of the charge transporting layer 106 is less than 2% by weight, modification of the charge transporting layer 106 by the fluorine containing resin particles is sometimes insufficient. On the other hand, in a case where the content exceeds 15% by weight, the light transmittance and the film strength may be lowered.

As the fluorine containing resin particles used in the exemplary embodiment, it is possible to select one or more from tetrafluoroethylene resin, trifluorochloro ethylene resin, hexafluoro propylene resin, vinyl fluoride resin, vinylidene fluoride resin, difluorodichloro ethylene resin and copolymers thereof. Tetrafluoroethylene resin and vinylidene fluoride resin may be used.

In the charge transporting layer 106, the fluoro graft polymer of the exemplary embodiment may be contained in an amount of from 0.5% by weight to 5% by weight based on the content of the fluorine containing resin particles. In a case where the content of the fluoro graft polymer is less than 0.5% by weight based on the content of the fluorine containing resin particles in the charge transporting layer 106, dispersion of the fluorine containing resin particles may not be uniform. On the other hand, in a case where it exceeds 5% by weight, this sometimes results in a problem of worsening the electric properties such as low chargeability and low sensitivity. The content of the fluoro graft polymer may be from 0.5% by weight to 5.0% by weight (or from about 0.5% by weight to about 5.0% by weight), or from 1.0% by weight to 4.0% by weight based on the content of the fluorine containing resin particles.

The fluoro graft polymer of the exemplary embodiment may be obtained by copolymerizing a macro monomer having a polymerizable functional group on one terminal end of a molecular chain and a polymerizable fluoro monomer having a fluoroalkyl group of 1 to 7 carbon atoms.

As the macro monomer, a polymer or a copolymer of acrylic acid esters, methacrylic acid esters, or styrenic compounds may be used. As the polymerizable fluoro monomer having fluoroalkyl groups of 1 to 7 carbon atoms, perfluoroalkyl ethyl methacrylate, perfluoroalkyl methacrylate, etc. may be used.

Polymerization ratio between the macromonomer and the polymeric fluoro monomer is not particularly limited so long as it is within such a range that the fluoro graft polymer of the exemplary embodiment may obtain a property of adsorbing to the fluorine containing resin particles, and the fluorine content in the fluoro graft polymer of the exemplary embodiment may be from 10% by weight to 50% by weight. In a case where the fluorine content is less than 10% by weight, adsorption of the fluoro graft polymer to the fluorine containing resin particles tends to be lowered to sometimes cause dispersion failure. On the other hand, in a case where the fluorine content exceeds 50% by weight, the solvent solubility of the fluoro graft polymer tends to be lowered sometimes making it difficult to be used as the dispersion aid. The fluorine content may be from 10% by weight to 40% by weight, or from 10% by weight to 30% by weight (or from about 10% by weight to about 30% by weight).

The fluoro graft polymer according to the exemplary embodiment may be a fluoroalkyl group-containing copolymer containing repeating units represented by the following structural formula A and the following structural formula B.

Structural formula A

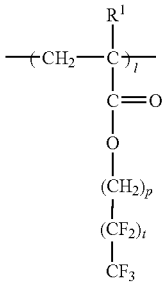

Structural formula B

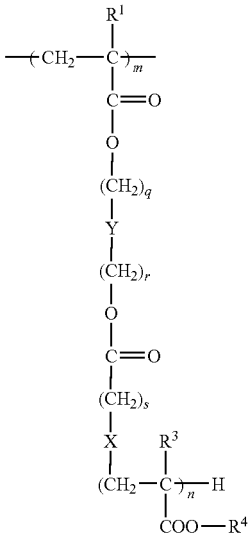

In the structural formula A and the structural formula B, l, m and n each independently represent a positive number of 1 or more, p, q, r and s each independently represent 0 or a positive number of 1 or more, t represents 0 or a positive number of 6 or less, $R^1$, $R^2$, $R^3$ and $R^4$ each independently represent a hydrogen atom or an alkyl group, X represents an alkylene group, a halogen-substituted alkylene group, —S—, —O—, —NH— or a single bond, Y represents an alkylene group, a halogen-substituted alkylene group, —($CH_zH_{2z-1}$(OH))— or a single bond, and z represents a positive number of 1 or more.

The charge transporting layer 106 may be formed by coating, on a conductive substrate, a coating liquid containing a treating liquid prepared by adding the fluoro resin particles to a solution containing the fluoro graft polymer according to the exemplary embodiment and conducting a treatment of adsorbing the fluoro graft polymer to the fluorine containing resin particles (sometimes referred to as an adsorption treating step hereinafter). A charge transporting material and a binder resin to be described later, etc. are added to the coating liquid.

In the adsorption treating step, after preparing the treating liquid by dissolving the fluoro graft polymer of the exemplary embodiment in an organic solvent at first, the fluorine containing resin particles are added to the treating liquid, and subjected to stirring or dispersing treatment thereby conducting the adsorption treatment of the fluoro graft polymer to the fluorine containing resin particles.

As the organic solvent used in the adsorption treating step, any solvent may be used so long as it is a solvent capable of dissolving the material used for forming the charge transporting layer 106, and examples thereof include organic solvents, for example, aromatic hydrocarbon solvents such as toluene and chlorobenzene, aliphatic alcohol solvents such as methanol, ethanol, n-propanol, iso-propanol, and n-butanol, ketone solvents such as acetone, cyclohexanone, and 2-butanone, halogenated aliphatic hydrocarbon solvents such as methylene chloride, chloroform, and ethylene chloride, cyclic or linear ether solvents such as tetrahydrofuran, dioxane, ethylene glycol, and diethyl ether, and ester solvents such as methyl acetate, ethyl acetate, and n-butyl acetate. Such solvents may be used each alone or two or more of them may be used in admixture. This step may be carried out at 30° C. or lower, or at 25° C. or lower.

A treating liquid formed by suspending the fluorine containing resin particles having the fluoro graft polymer adsorbed thereto in the step described above is added in the organic solvent in which a charge transporting material, a binder resin, etc. to be described later are dissolved, and they are mixed under stirring. The mixed liquid is subjected to a dispersing treatment to obtain a coating liquid for forming the charge transporting layer in which the fluorine containing resin particles are dispersed.

For the dispersing method, a media dispersing machines such as ball mill, vibration ball mill, attriter, sand mill, horizontal sand mill, and medialess dispersing machines such as stirrer, ultrasonic dispersing machine, roll mill, or high pressure homogenizer may be utilized. Further, examples of the high pressure homogenizer include those of a collision type of dispersing the dispersion liquid by liquid-liquid collision or liquid-wall collision in a high pressure state, or a flow through type of dispersing the dispersion liquid by flowing through a fine flow channel in a high pressure state.

Examples of the organic solvent used for dissolving the charge transporting material and the binder resin include, for example, aromatic hydrocarbon solvents such as toluene and chlorobenzene, aliphatic alcohol solvents such as methanol, ethanol, n-propanol, iso-propanol, and n-butanol, ketone solvents such as acetone, cyclohexanone, and 2-butanone, halogenated aliphatic hydrocarbon solvents such as methylene chloride, chloroform, and ethylene chloride, cyclic or linear ether solvents such as tetrahydrofuran, dioxane, ethylene glycol, and diethyl ether, and ester solvents such as methyl acetate, ethyl acetate, and n-butyl acetate. Such solvents may be used each alone or two or more of them may be used in admixture. When two or more organic solvents are mixed, any solvents may be used which dissolve the binder resin to be described later in the mixed solvent.

The charge transporting layer 106 may further include in addition to the ingredients described above, a charge transporting material for developing the inherent function as the charge transporting layer, and further a binder resin. Examples of the charge transporting layer include, for example, hole transporting materials, for example, oxadiazole derivatives such as 2,5-bis(p-diethylaminophenyl)-1,3,4-oxadiazole, pyrazolin derivatives such as 1,3,5-triphenyl-pirazolin and 1-[piridyl-(2)]-3-(p-diethyl amino styryl)-5-(p-diethylaminostyryl)pirazolin, aromatic tertiary amino compounds such as triphenyl amine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triadine derivatives such as 3-(4'-dimethylaminophenyl)-5,6-di-(4'-methoxyphenyl)-1,2,4-triadine, hydrazone derivatives such as 4-diethylamino benzaldehyde-1,1-diphenyl hydrazone, quinazoline derivatives such as 2-phenyl-4-styryl quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, poly-N-vinyl carbazole and derivatives thereof, electron transporting materials, for example, quinone compounds such as chloranil and broanthraquinone, tetranoquinodimethane compounds, fluorenone compounds such as 2,4,7-trinitrofluorenone and 2,4,5,7-tetranitro-9-fluorenone, xanthone compounds, and thiophene compounds, and polymers having groups containing the compound described above in the main chain or the side chain. The charge transporting materials described above may be used each alone or two or more of them may be used in combination in use.

Further, examples of the binder resin in the charge transporting layer 106 include resins, for example, polycarbonate resin, for example, bisphenol A type or bisphenol Z type, acrylic resin, methacrylic resin, polyarylate resin, polyester resin, polyvinyl chloride resin, polystyrene resin, acrylonitrile-styrene copolymer resin, acrylonitrile-butadiene copolymer resin, polyvinyl acetate resin, polyvinyl formal resin, polysulfone resin, styrene-butadiene copolymer resin, vinylidene chloride-acrylonitrile copolymer resin, vinyl chloride-vinyl acetate-maleic acid anhydride resin, silicone resin, phenol-formaldehyde resin, polyacrylamide resin, polyamide resin, and chlororubber, as well as organic photoconductive polymers such as polyvinyl carbazole, polyvinyl anthracene, polyvinyl pyrene. Such binder resins may be used each alone or two or more may be used in admixture.

The blending ratio of the charge transporting material and the binder resin may be from 10:1 to 1:5.

With an aim of improving the smoothness at the surface of the charge transporting layer 106, a leveling agent such as silicone oil may be added to the coating liquid for forming the charge transporting layer. The leveling agent may be added in any amount so long as it is in a range capable of improving the surface smoothness, and it may be used in a range of from 0.1 ppm to 1000 ppm in the coating liquid. More specifically, it may be used in a range of from 0.5 ppm to 500 ppm. In a case where the leveling agent is used in an amount less than 0.1 ppm, no sufficient smooth surface may be obtained. On the other hand, in a case where it is used in excess of 500 ppm, this may be sometimes not preferred with a view point of the electric property such that increase of the residual potential occurs upon repetitive use.

As the method of coating the coating liquid for forming the charge transporting layer obtained as described above on the charge generating layer 105, a usual method, for example, dip coating, push-up coating, wire bar coating, spray coating, blade coating, ring coating, knife coating, and curtain coating may be used. The thickness of the charge transporting layer 106 may be in a range of from 5 μm to 50 μm, or from 10 μm to 40 μm.

Further, with an aim of preventing deterioration of a photoreceptor due to light or heat, or ozone or nitrogen oxide generated in an image forming apparatus, additives such as an antioxidant, an optical stabilizer, and a heat stabilizer may be added further to each of the layers constituting the photosensitive layer 103. Examples of the antioxidant includes, for example, hindered phenol, hindered amine, parapheylene diamine, aryl alkane, hydroquinone, spirochromane, spiroindanone, and derivative thereof, organic sulfur compounds and organic phosphor compounds. Examples of the light stabilizer include, for example, derivatives of benzophenone, benzoazole, dithiocarbamate, and tetramethylpipen.

(Image Forming Apparatus and Process Cartridge)

Then, an image forming apparatus and a process cartridge of the exemplary embodiment are to be described.

Figure 3:
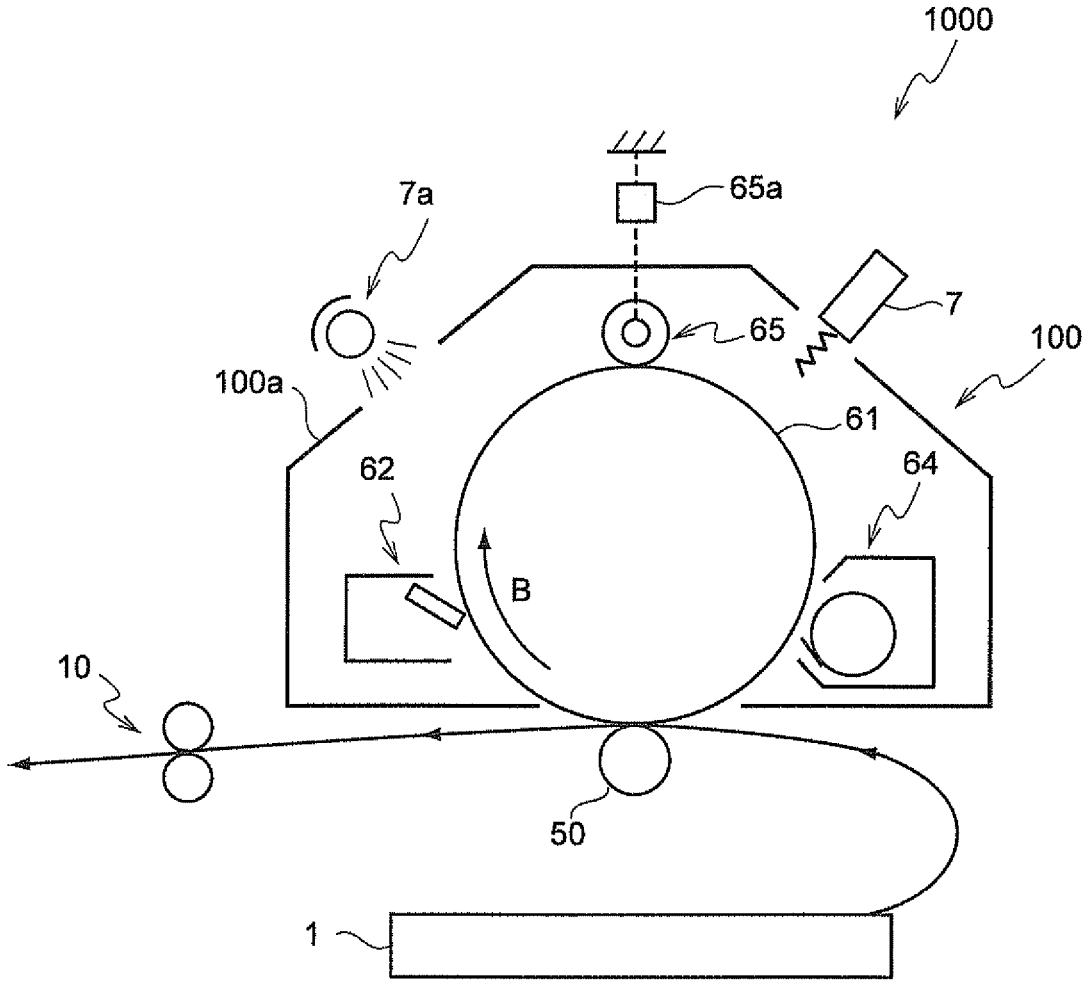
FIG. 3 is an entire constitutional view showing a first example of an image forming apparatus according to the exemplary embodiment.

FIG. 3 is an entire constitutional view showing a first example of an image fowling apparatus of the exemplary embodiment.

The image forming apparatus 1000 is a monochromatic one side output printer using an electrophotographic system.

The image forming apparatus 1000 has an image holder 61 which is an electrophotographic photoreceptor that rotates in the direction of an arrow 13 in the drawing, and a charging member 65 that rotates in contact with the image holder 61 under supply of an electric power from a power source 65*a* thereby charging the surface of the image holder. In this case, the image holder 61 corresponds to an example of an electrophotographic photoreceptor of the exemplary embodiment.

Further, the image forming apparatus 1000 also includes an exposure section 7 as an electrostatic latent image forming unit that emits a laser light to the image holder 61 thereby forming an electrostatic latent image on the surface of the image holder 61, a developing device 64 as an image forming unit that forms a toner image by depositing a monochromatic (black) toner to the electrostatic latent image formed on the surface of the image holder 61 by using an electrostatic latent image developer including a black toner, thereby developing the electrostatic latent image, a transfer roll 50 as a transfer unit that transfer a toner image formed on the surface of the image holder 61 to paper as a transfer receiving body by pressing the conveyed paper against the image holder 61 on which the toner image is formed, a fixing device 10 as a fixing unit that fixes a transfer image on the paper by applying heat and pressure to the toner image transferred to the paper, a cleaning device 62 as a cleaning unit that is in contact with the image holder 61 and removes the residual toner remained and deposited to the surface of the image holder 61 after transfer of the toner image, and a charge elimination lamp 7*a* that eliminates charges remaining on the image holder 61 after the transfer of the toner image.

In the image forming apparatus 1000, each of the charging member 65 and the image holder 61 is in a roll shape extending in a direction perpendicular to the drawing of FIG. 3 and both ends of the rolls are supported by a support member 100*a* in a state where the roll is rotatable. Further, the cleaning device 62 and the developing device 64 described above are also connected to the support member 100*a*, and the process cartridge 100 is constructed by disposing the charging member 65, the image holder 61, the cleaning device 62, and the developing device 64 integrally in the support member 100*a*.

By incorporating the process cartridge into the image forming apparatus 1000, each of the components of the process cartridge is provided in the image forming apparatus 1000. The process cartridge 100 corresponds to an example of the process cartridge of the exemplary embodiment.

The operation of forming an image in the forming apparatus 1000 is to be described.

The image forming apparatus 1000 is provided with a not illustrated toner cartridge that stores a black toner, and a toner is supplemented by the toner cartridge to the developing device 64. Further, paper used for the transfer of the toner image is stored in a paper feed unit 1 and, when a user instructs image formation, the paper is conveyed from the paper feed unit 1, the toner image is transferred thereto in the transfer roll 50, and the paper is then conveyed leftward in the drawing. In FIG. 3, the paper conveying path in this case is shown as a path illustrated by a leftward arrow, and paper is passed through the paper conveying path, the transfer image transferred onto the paper is fixed in the fixing device 10, and the paper is then discharged leftward.

When the charging member 65 charges the image holder 61, a voltage is applied to the charging member 65. With respect to the range of the voltage, a DC voltage may be positive or negative 50V or more but 2000 V or less, or 100 V or more but 1500 V or less in accordance with the required charging potential of the image holder. In a case of superimposing an AC voltage, a peak-to-peak voltage may be 400 V or more but 1800 V or less, 800 V or more but 1600 V or less, or 1200 V or more but 1600 V or less. The frequency for the AC voltage may be 50 Hz or higher but 20,000 Hz or lower, or 100 Hz or higher but 5,000 Hz or lower.

As the charging member 65, those having a core member provided with an elastic layer, a resistant layer, a protective layer, etc. at the peripheral surface thereof may be used. The charging member 65 rotates at a peripheral speed identical with that of the image holder 61 and functions as the charging unit by being in contact with the image holder 61 with no particular provision of driving unit. However, a driving unit may be attached to the charging member 65 to rotate the member at a peripheral speed different from that of the image holder 61 when charging is carried out.

As the exposure section 7, an optical system device that exposes the surface of the electrophotographic photoreceptor to an optical source such as a semiconductor laser, LED (light emitting diode), a liquid crystal shutter, etc. in an intended image form may also be used.

As the developing device 64, a developing device known so far using a one-component or two-component regular or reversal developer may also be used. The shape of the toner used for the developing device 64 is not particularly limited, and may be an indefinite shape, spherical or other particular shape.

Examples of the transfer unit include contact charging members such as a transfer roll 50, etc. as well as a contact type transfer charger using belt, film, rubber blade, or the like, or a scorotron transfer charger or a corotron transfer charger utilizing corona discharge.

The cleaning device 62 is used for removing the residual toner deposited on the surface of the image holder 61 after the transfer step, by which the image holder 61 cleaned at the surface is used repetitively in the image forming process. As the cleaning device, a cleaning blade, as well as brush cleaning, roll cleaning, etc. may be used. Among them, the cleaning blade may be used. Further, the material for the cleaning blade may be, for example, urethane rubber, neoprene rubber, or silicone rubber.

Since the surface layer of the electrophotographic photoreceptor of the exemplary embodiment contains the fluorine containing resin particles, the surface energy is low. Accordingly, when a cleaning blade is used for the cleaning device 62, abrasion of the surface layer less occurs and a stable image is formed for a long time.

In the image forming apparatus according to the exemplary embodiment, since the charge elimination lamp 7*a* is provided, when the image holder 61 is used repetitively, this prevents the phenomenon that the residual potential on the image holder 61 is carried over into the succeeding cycle, so that the image quality is enhanced further. The image forming apparatus of the exemplary embodiment may optionally have a charge elimination lamp 7*a* when it is required.

Figure 4:
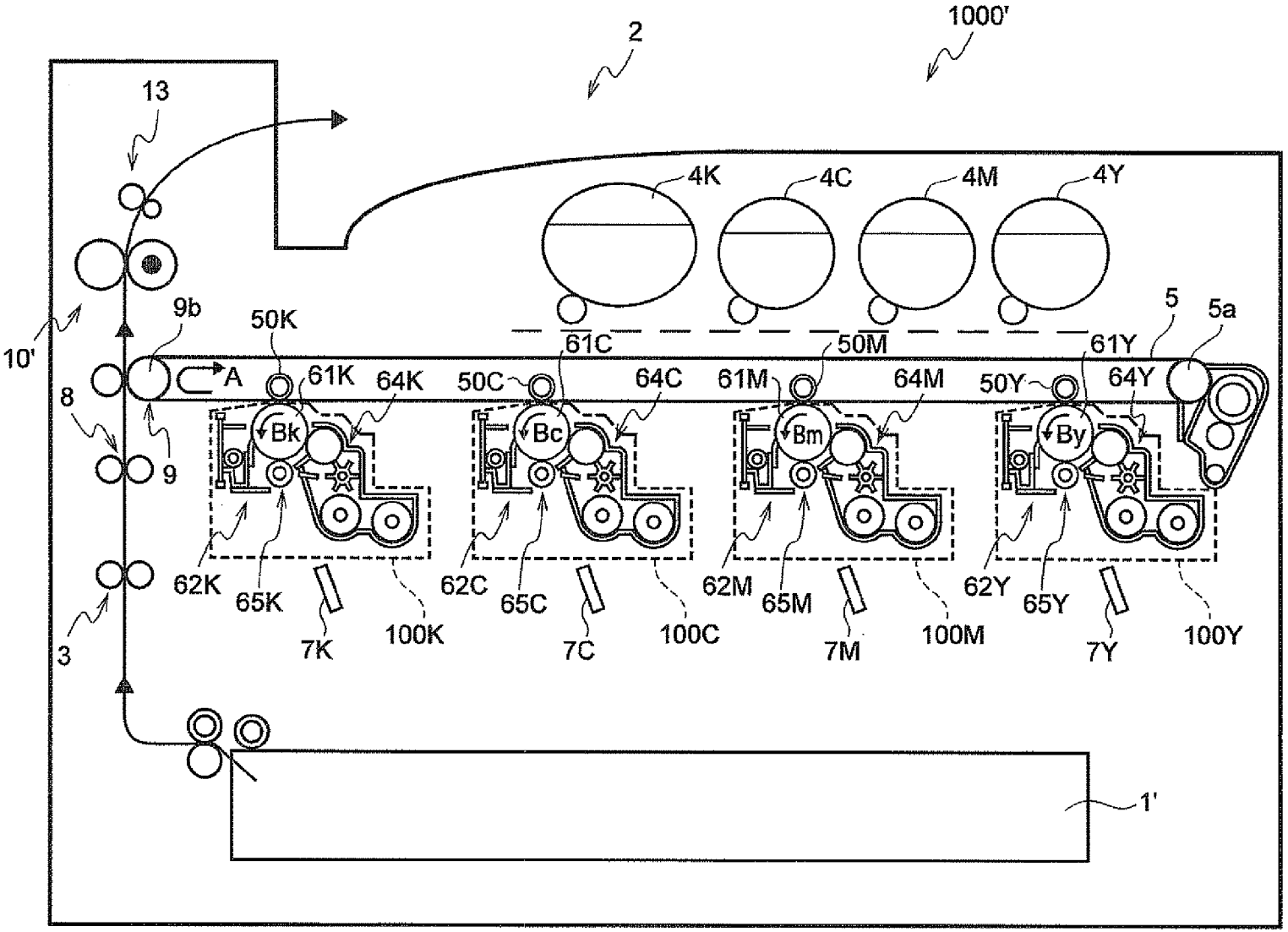
FIG. 4 is an entire constitutional view showing a second example of an image forming apparatus according to the exemplary embodiment.

FIG. 4 is an entire constructional view showing a second example of an image forming apparatus of the exemplary embodiment.

The image forming apparatus 1000' of the exemplary embodiment is a color printer.

The image forming apparatus 1000' is provided with image holders 61K, 61C, 61M, and 61Y as electrophotographic photoreceptors that rotate in the direction of arrows Bk, Be, Bm and By in the drawing respectively. In this case, the image holders 61K, 61C, 61M, and 61Y correspond to an example of electrophotographic photoreceptors according to the exemplary embodiment.

Further, respective image holders are provided at the periphery thereof with charging members 65K, 65C, 65M, and 65Y as charging units that charge the surface of the image holders by rotation while in contact with the respective image holders, exposure sections 7K, 7C, 7M and 7Y as electrostatic latent image forming units that form electrostatic latent images for respective colors of black (K), cyan (C), magenta (M), and yellow (Y) on the respective charged image holders by the irradiation of a laser light, and developing devices 64K, 64C, 64M, and 64Y as developing units that form toner images of respective colors by developing the electrostatic latent images on the respective image holders with the electrostatic latent image developers containing toners of respective colors.

In the image forming apparatus 1000', among each of the constituent elements described above, the charging member 65K, the image holder 61K, the cleaning device 62K, and the developing device 64K for the black color are integrated to form a constituent element for the process cartridge 100K. In the same manner, a set of the charging member 65C, the image holder 61C, the cleaning device 62C, and the developing device 64C for the cyan color, a set of the charging member 65M, the image holder 61Y, the cleaning device 62M, and the developing device 64M for the magenta color, and a set of the charging member 65Y, the image holder 61Y, the cleaning device 62Y, and the developing device 64Y for the yellow color are integrated respectively to form constituent elements for the process cartridges 100C, 100M and 100Y. By incorporating the four process cartridges into the image forming apparatus 1000', each of the components of the process cartridges are provided in the image forming apparatus 1000'. Each of process cartridges 100K, 100C, 100M, and 100Y corresponds to an example of the process cartridge of the exemplary embodiment.

Further, the image forming apparatus 1000' also has an intermediate transfer belt 5 as an intermediate transfer body that receives transfer of the toner image for each color formed on each image holder (primary transfer) and conveys the primary transfer image, primary transfer rolls 50K, 50C, 50M and 50Y for primary transfer of toner images for respective colors to the intermediate transfer belt 5, secondary transfer roll pair 9 for secondary transfer to the paper, a fixing device 10' as a fixing unit for fixing the toner image undergoing secondary transfer on the paper, four toner cartridges 4K, 4C, 4M and 4Y for supplementing toners of respective color components to the four developing devices, and a paper feed unit 1' for storing paper.

In this case, the intermediate transfer belt 5 moves and circulates in the direction of an arrow A in the drawing in a state stretched between a second transfer roll 9*b* and a driving roll 5*a* while undergoing a driving force from the driving roll 5*a*.

In the foregoing description, although the case of using the intermediate transfer belt 5 as the intermediate transfer body has been described, the intermediate transfer body may be in a belt shape as in the intermediate transfer belt 5 or in a drum shape. In the case of the belt shape, the resin material used as the base material for the intermediate transfer body may be a known resin and examples thereof include, for example, resin materials such as polyimide resin, polycarbonate resin (PC), polyvinylidene fluoride (PVDF), polyalkylene terephthalate (PAT), blend material of an ethylene tetrafluoroethylene copolymer (ETFE)/PC, ETFE/PAT, or PC/PAT, polyester, polyether ether ketone, and polyamide, as well as resin materials including them as main raw materials. Further, the resin material and the elastic material may be used as a blend.

Then, the operation of forming an image in the image forming apparatus 1000' is to be described.

Four image holders 61K, 61C, 61M, and 61Y are charged by the charging members 65K, 65C, 65M, and 65Y respectively and further receive a laser light irradiated from the exposure sections 7K, 7C, 7M, and 7Y thereby forming electrostatic latent images on the respective image holders. The formed electrostatic latent images are developed by the electrostatic latent image developers containing toners of respective colors by the developing devices 64K, 64C, 64M, and 64Y to form toner images on the respective image holders. The toner images of respective colors formed as described above are transferred and stacked in the order of yellow (Y), magenta (M), cyan (C), and black (K) on the intermediate transfer belt 5 (primary transfer) with the primary transfer rolls 50K, 50C, 50M, and 50Y for the respective colors, and a multi-color primary transfer image is formed.

Then, the multi-color primary transfer image is conveyed by the intermediate transfer belt 5 to the secondary transfer roll pair 9. Meanwhile, corresponding to the formation of the multi-color primary transfer image, paper is taken out of the paper feed unit 1', conveyed by the conveyer roll 3, and further registered for the position by the positioning roll pair 8. Then, the multi-color primary transfer image is transferred by the secondary transfer roll pair 9 to the conveyed paper (second transfer), and a secondary transfer image on the paper is further subjected to a fixing treatment by the fixing device 10'. After the fixing treatment, the paper having the fixed image is passed through the delivery roll pair 13 and then discharged to the exhaust paper receiver 2.

The operation of forming the image in the image forming apparatus 1000' is as described above.

The process cartridge of the exemplary embodiment is not particularly limited so long as it has an electrophotographic photoreceptor according to the exemplary embodiment and is attachable to and detachable from the image forming apparatus. For example, it may integrally have at least one selected from the group consisting of charging unit that charges the electrophotographic photoreceptor, an electrostatic latent image forming unit that forms an electrostatic latent image on the charged electrophotographic photoreceptor, a developing unit that develops the electrostatic latent image formed on the electrophotographic photoreceptor by the electrostatic latent image developer to form the toner image, a transfer unit that transfers the toner image formed on the electrophotographic photoreceptor to the transfer receiving body, and cleaning unit that removes the residual toner of the electrophotographic photoreceptor after the transfer.

EXAMPLES

The present invention is to be described more specifically based on examples and comparative examples but the invention is not restricted to the following examples at all.

Example 1

100 parts by weight of zinc oxide (average particle diameter; 70 nm, manufactured by Tayca Corporation, specific surface area: 15 $m^2/g$) are mixed under stirring with 500 parts by weight of methanol, 1.25 parts by weight of KBM603 (manufactured by Shin-Etsu Chemical Co., Ltd.) is added as a silane coupling agent, and they are stirred for 2 hours. Then, methanol is distilled off by vacuum distillation, and baking is effected at 120° C. for 3 hours to obtain zinc oxide particles surface treated with the silane coupling agent.

38 parts by weight of a solution prepared by dissolving 60 parts by weight of the surface treated zinc oxide particles, 0.6 parts by weight of alizarin, 13.5 parts by weight of block isocyanate as a hardening agent (SUMIDULE 3173, manufactured by Sumitomo Bayer Urethane Co., Japan), and 15 parts by weight of a butyral resin (S-Lee BM-1, manufactured by Sekisui Chemical Co., Ltd.) in 85 parts by weight of methyl ethyl ketone, and 25 parts by weight of methyl ethyl ketone are mixed and dispersed for 4 hours in a sand mill using glass beads of 1 mm diameter to obtain a dispersion liquid. 0.005 parts by weight of dioctyltin dilaurate as a catalyst and 4.0 parts by weight of silicone resin particles (TOSPEARL 145, manufactured by GE Toshiba Silicone Co., Ltd.) are added to the obtained dispersion liquid to obtain a liquid for coating an undercoating layer. The coating liquid is coated on an aluminum substrate of 30 mm diameter by a dip coating method and dried and cured at 180° C. for 40 minutes to obtain an undercoating layer of 25 μm thickness.

Then, a mixture including 15 parts by weight of chlorogallium phthalocyanine crystals having intense diffraction peaks at least at 7.4°, 16.6°, 25.5°, and 28.3° of Bragg angle (2θ±0.2° to CuKα characteristic X-rays as a charge generating material, 10 parts by weight of a vinyl chloride-vinyl acetate copolymer resin (VMCH, manufactured by Union Carbide Japan KK), and 300 parts by weight of n-butyl alcohol is dispersed by a sand mill using glass beads of 1 mm diameter for 4 hours to obtain a coating liquid for the charge generating layer, and the coating liquid for the charge generating layer is dip coated on the undercoating layer and dried to obtain a charge generating layer of 0.2 μm thickness.

Then, a liquid A: 1 part by weight of tetrafluoroethylene resin particles (average primary particle diameter: 0.2 μm) is added to a liquid prepared by dissolving 0.03 parts by weight of a fluoroalkyl group-containing methacryl polymer (The area for a molecular weight of 700,000 or more in the GPC chart is 10% of the total area, the maximum peak in the GPC chart is present at the molecular weight of 69,000, and the fluorine content is 20% by weight. Further, the molecular structure is as shown below. In the following molecular formula, l, m, and n represent 1, 1, and 60 respectively.) in 2.33 parts by weight of toluene, and mixed under stirring for 48 hours while keeping a liquid temperature of 20° C. to obtain a suspension liquid of the tetrafluoroethylene resin particles.

Then, a liquid B: 5.32 parts by weight of N,N'-bis(3-methylphenyl)-N,N-diphenylbenzidine as a charge transporting material, 7.05 parts by weight of a bisphenol Z polycarbonate resin (viscosity average molecular weight: 40,000) as a binder resin, 0.13 parts by weight of 2,6-di-t-butyl-4-methylphenol as an antioxidant, 24 parts by weight of tetrahydrofuran and 11 parts by weight of toluene are mixed and dissolved.

After the liquid A is added to the liquid B and mixed with stirring, a dispersion treatment is repeated by 4 times by increasing the pressure to 500 $kgf/cm^2$ (49 MPa) and by using a high pressure homogenizer provided with a flow-through chamber having fine flow channels (manufactured by Yoshida Kikai Kogyo Co., Ltd.), and 5 ppm of silicone oil (trade name of products, KP340, manufactured by Shin-Etsu Silicone Co., Ltd.) is added to the liquid, and stirred to obtain a coating liquid for forming a charge transporting layer.

Structural formula A

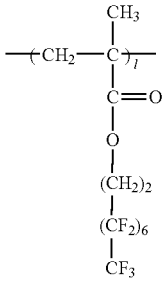

Structural formula B

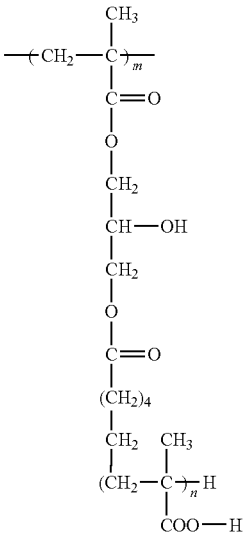

The coating liquid is coated on the charge generating layer, dried at 135° C. for 40 minutes to form a charge transporting layer of 30 μm thickness thereby obtaining an aimed electrophotgraphic photoreceptor.

Print test and potential measurement are performed by using a modified machine of a full color printer DocuCentre Color f450 manufactured by Fuji Xerox Co., Ltd. having the thus obtained photoreceptor mounted to a drum cartridge, under a condition of 28° C./85% RH. The obtained result is shown in Table 1.

The potential measurement is practiced by the following method.

A measurement is performed by attaching a potential sensor to the modified machine of the full color printer DocuCentre Color f450 manufactured by Fuji Xerox Co., Ltd. described above.

In Example 1, the content of the fluoroalkyl group-containing methacryl copolymer based on the content of tetrafluoroethylene resin particles is 3% by weight.

Example 2

In the same manner as in Example 1, an undercoating layer and a charge generating layer are formed on an aluminum substrate.

Then, a liquid A: 1 part by weight of tetrafluoroethylene resin particles (average primary particle diameter: 0.2 μm) is added to a liquid prepared by dissolving 0.02 parts by weight of a fluoroalkyl group-containing methacryl polymer (The area for a molecular weight of 700,000 or more in the GPC chart is 5% of the total area, the maximum peak in the GPC chart is present at the molecular weight of 65,000 and a fluorine content is 18% by weight. Further, the molecular structure is as shown below. In the following molecular formula, l, m, n, and s represent 1, 1, 60, and 1 respectively) in a solvent mixture including 1.63 parts by weight of tetrahydrofuran and 0.70 parts by weight of toluene, and mixed under stirring for 48 hours while keeping a liquid temperature of 20° C. to obtain a suspension liquid of tetrafluoroethylene resin particles.

Then, a liquid B: 5.32 parts by weight of N,N-bis(3-methylphenyl)-N,N-diphenylbenzidine as a charge transporting material, 7.05 parts by weight of bisphenol Z polycarbonate resin (viscosity average molecular weight: 40,000) as a binder resin, 0.13 parts by weight of 2,6-di-t-butyl-4-methylphenol as an antioxidant, 26.25 parts by weight of tetrahydrofuran, and 9.92 parts by weight of toluene are mixed and dissolved.

After adding the liquid A to the liquid B and mixing them by stirring, a dispersion treatment is repeated by 4 times by increasing the pressure to 500 kgf/cm$^2$ (49 MPa) and by using a high pressure homogenizer provided with a flow-through chamber having fine flow channels (manufactured by Yoshida Kikai Kogyo Co., Ltd.), and 5 ppm of silicone oil (trade name of products, KP340, manufactured by Shin-Etsu Silicone Co., Ltd.) is added to the liquid, and stirred to obtain a coating liquid for forming a charge transporting layer.

Structural formula A

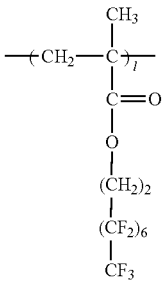

Structural formula B

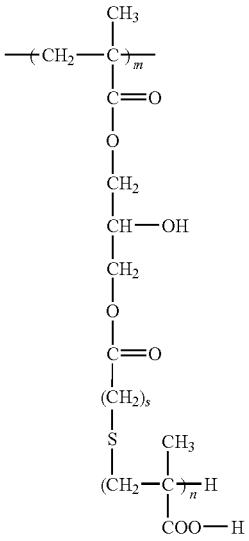

The coating liquid is coated on the charge generating layer, dried at 135° C. for 40 minutes to form a charge transporting layer of 30 μm thickness thereby obtaining an aimed electrophotgraphic photoreceptor.

Print test and potential measurement are performed by using a modified machine of a full color printer DocuCentre Color f450 manufactured by Fuji Xerox Co., Ltd. having the thus obtained photoreceptor mounted to a drum cartridge, under a condition of 28° C./85% RH. The obtained result is shown in Table 1.

In Example 2, the content of the fluoroalkyl group-containing methacryl copolymer based on the content of tetrafluoroethylene resin particles is 2% by weight.

Example 3

In the same manner as in Example 1, an undercoating layer and a charge generating layer are formed on an aluminum substrate.

Then, a liquid A: 1 part by weight of tetrafluoroethylene resin particles (average primary particle diameter: 0.2 μm) is added to a liquid prepared by dissolving 0.03 parts by weight of a fluoroalkyl group-containing methacryl copolymer (The area for a molecular weight of 700,000 or more in the GPC chart is 15% of the total area, the maximum peak in the GPC chart is present at the molecular weight of 70,000 and a fluorine content is 19% by weight. Further, the molecular structure is as shown below. In the following molecular formula, l, m, n, and s represent 1, 1, 60, and 1, respectively.) in 2.33 parts by weight of toluene, and mixed under stirring for 48 hours while keeping a liquid temperature of 20° C. to obtain a suspension liquid of the tetrafluoroethylene resin particles.

Then, a liquid B: 5.32 parts by weight of N,N-bis(3-methylphenyl)-N,N'-diphenylbenzidine as a charge transporting material, 7.05 parts by weight of a bisphenol Z polycarbonate resin (viscosity average molecular weight: 40,000) as a binder resin, 0.13 parts by weight of 2,6-di-t-butyl-4-methylphenol as an antioxidant, 26.25 parts by weight of tetrahydrofuran and 9.92 parts by weight of toluene are mixed and dissolved.

After adding the liquid A to the liquid B and mixing them by stirring, a dispersion treatment is repeated by 4 times by increasing the pressure to 500 kgf/cm$^2$ (49 MPa) and by using a high pressure homogenizer provided with a flow-through chamber having fine flow channels (manufactured by Yoshida Kikai Kogyo Co., Ltd.), and 5 ppm of silicone oil (trade name of products, KP340, manufactured by Shin-Etsu Silicone Co., Ltd.) is added to the liquid, and stirred to obtain a coating liquid for forming a charge transporting layer.

Structural formula A

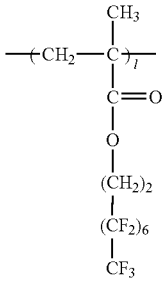

-continued

Structural formula B

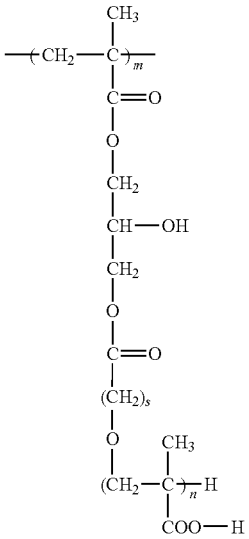

The coating liquid is coated on the charge generating layer, dried at 135° C. for 40 minutes to form a charge transporting layer of 30 μm thickness, thereby obtaining an aimed electrophotgraphic photoreceptor.

Print test and potential measurement are performed by using a modified machine of a full color printer DocuCentre Color f450 manufactured by Fuji Xerox Co., Ltd. having the thus obtained photoreceptor mounted to a drum cartridge, under a condition of 28° C./85% RH. The obtained result is shown in Table 1.

In Example 3, the content of the fluoroalkyl group-containing methacryl copolymer based on the content of the tetrafluoroethylene resin particles is 3% by weight.

Comparative Example 1

A coating liquid for forming a charge transporting layer is prepared by the same method as in Example 1 except for using 0.03 parts by weight of a fluoroalkyl group containing methacryl copolymer (The area for a molecular weight of 700,000 or more in the GPC chart is 1% of the total area, the maximum peak in the GPC chart is present at the molecular weight of 70,000 and a fluorine content is 20% by weight. Further, the molecular structure is as shown below. In the following molecular formula, l, m, and n represent 1, 1, and 60, respectively.) in Example 1, thereby obtaining an electrophotographic photoreceptor. Same evaluation as in Example 1 is effected by using the obtained photoreceptor. The obtained result is shown in Table 1.

Structural formula A

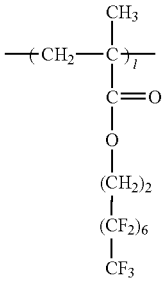

-continued

Structural formula B

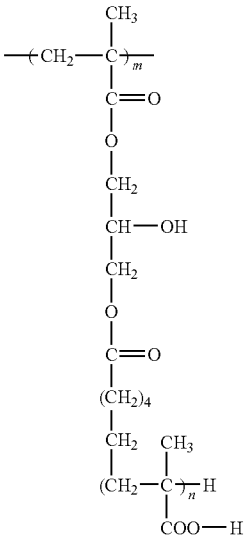

In Comparative Example 1, the content of the fluoroalkyl group-containing methacryl copolymer is 3% by weight based on the content of the tetrafluoroethylene resin particles.

Comparative Example 2

A coating liquid for forming a charge transporting layer is prepared by the same method as in Example 1 except for using 0.03 parts by weight of a fluoroalkyl group containing methacryl polymer (The area for a molecular weight of 700,000 or more in the GPC chart is 25% of the total area, the maximum peak in the GPC chart is present at the molecular weight of 70,000, and a fluorine content is 15% by weight. Further, the molecular structure is as shown below. In the following molecular formula, l, m, n, and s represent 1, 1, 60, and 1, respectively.) in Example 1, thereby obtaining an electrophotographic photoreceptor. Same evaluation as in Example 1 is effected by using the obtained photoreceptor. The obtained result is shown in Table 1.

Structural formula A

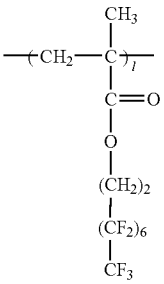

-continued

Structural formula B

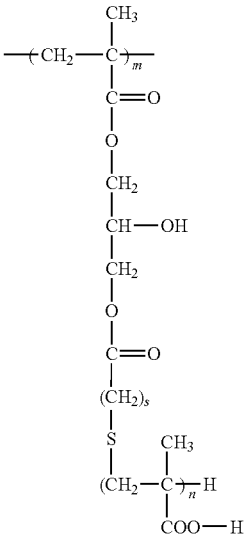

In Comparative Example 2, the content of the fluoroalkyl group-containing methacryl copolymer is 3% by weight based on the content of the tetrafluoroethylene resin particles.

TABLE 1

| | Residual potential increase after print test of 10,000 sheets (under condition at 28° C./85%) | Print test (at 10,000th half-tone sheet) |
|---|---|---|
| Example 1 | Residual potential increase 5 V | No density lowering |
| Example 2 | Residual potential increase 15 V | No density lowering |
| Example 3 | Residual potential increase 10 V | No density lowering |
| Comp. Example 1 | Residual potential increase 80 V | Density lowering occurred |
| Comp. Example 2 | Residual potential increase 100 V | Density lowering occurred |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate, at least a photosensitive layer on the conductive substrate, and a surface layer located at a surface of the photosensitive layer side of the electrophotographic photoreceptor, wherein the surface layer contains fluorine containing resin particles and a fluoro graft polymer having a fluoroalkyl group having 1 to 7 carbon atoms, the fluoro graft polymer having a fluoroalkyl group having 1 to 7 carbon atoms has a molecular distribution such that an area in a gel permeation chromatography (GPC) chart of the fluoro graft polymer for a polystyrene equivalent molecular weight of 700,000 or more is about 5% to about 20% of a total area in the GPC chart of the fluoro graft polymer, a maximum peak in the GPC chart of the fluoro graft polymer is present in a range where a polystyrene equivalent molecular weight is from about 50,000 to about 150,000, and the fluorine content in the fluoro graft polymer is from about 10% by weight to about 30% by weight with respect to a weight of the fluoro graft polymer.

2. The electrophotographic photoreceptor of claim 1, wherein the content of the fluoro graft polymer is from about 0.5% by weight to about 5.0% by weight based on the content of the fluorine containing resin particles.

3. The electrophotographic photoreceptor of claim 1, wherein the fluoro graft polymer is a fluoroalkyl group-containing copolymer containing repeating units represented by the following structural formulae A and B:

Structural formula A

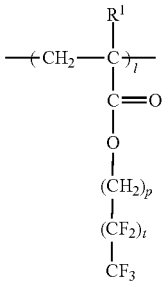

Structural formula B

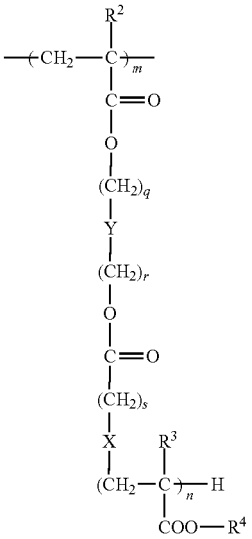

wherein l, m and n each independently represent a positive number of 1 or more;

p, q, r and s each independently represent 0 or a positive number of 1 or more;

t represents 0 or a positive number of 6 or less;

$R^1$, $R^2$, $R^3$ and $R^4$ each independently represent a hydrogen atom or an alkyl group;

X represents an alkylene group, a halogen-substituted alkylene group, —S—, —O—, —NH— or a single bond;

Y represents an alkylene group, a halogen-substituted alkylene group, —($C_zH_{2z-1}$(OH))— or a single bond; and z represents a positive number of 1 or more.

4. A process cartridge which is attachable to and detachable from an image forming apparatus, and comprises an electrophotographic photoreceptor, the electrophotographic photoreceptor comprising:

a conductive substrate, at least a photosensitive layer on the conductive substrate, and a surface layer located at a surface of the photosensitive layer side of the electrophotographic photoreceptor, wherein the surface layer contains fluorine containing resin particles and a fluoro graft polymer having a fluoroalkyl group having 1 to 7 carbon atoms, the fluoro graft polymer having a fluoroalkyl group having 1 to 7 carbon atoms has a molecular distribution such that an area in a gel permeation chromatography (GPC) chart of the fluoro graft polymer for a polystyrene equivalent molecular weight of 700,000 or more is about 5% to about 20% of a total area in the GPC chart of the fluoro graft polymer, a maximum peak in the GPC chart of the fluoro graft polymer is present in a range where a polystyrene equivalent molecular weight is from about 50,000 to about 150,000, and the fluorine content in the fluoro graft polymer is from about 10% by weight to about 30% by weight with respect to a weight of the fluoro graft polymer.

5. The process cartridge of claim 4, wherein the content of the fluoro graft polymer is from about 0.5% by weight to about 5.0% by weight based on the content of the fluorine containing resin particles.

6. The process cartridge of claim 4, wherein the fluoro graft polymer is a fluoroalkyl group-containing copolymer containing repeating units represented by the following structural formulae A and B:

Structural formula A

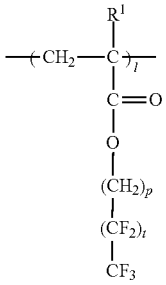

-continued

Structural formula B

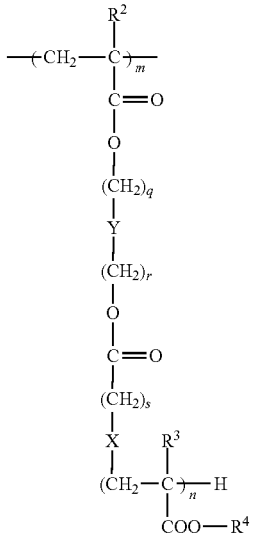

wherein l, m and n each independently represent a positive number of 1 or more;

p, q, r and s each independently represent 0 or a positive number of 1 or more;

t represents 0 or a positive number of 6 or less;

$R^1$, $R^2$, $R^3$ and $R^4$ each independently represent a hydrogen atom or an alkyl group;

X represents an alkylene group, a halogen-substituted alkylene group, —S—, —O—, —NH— or a single bond;

Y represents an alkylene group, a halogen-substituted alkylene group, —($C_zH_{2z-1}$(OH))— or a single bond; and z represents a positive number of 1 or more.

7. An image forming apparatus comprising:

an electrophotographic photoreceptor comprising:

a conductive substrate, at least a photosensitive layer on the conductive substrate, and a surface layer located at a surface of the photosensitive layer side of the electrophotographic photoreceptor, wherein the surface layer contains fluorine containing resin particles and a fluoro graft polymer having a fluoroalkyl group having 1 to 7 carbon atoms, the fluoro graft polymer having a fluoroalkyl group having 1 to 7 carbon atoms has a molecular distribution such that an area in a gel permeation chromatography (GPC) chart of the fluoro graft polymer for a polystyrene equivalent molecular weight of 700,000 or more is about 5% to about 20% of a total area in the GPC chart of the fluoro graft polymer, a maximum peak in the GPC chart of the fluoro graft polymer is present in a range where a polystyrene equivalent molecular weight is from about 50,000 to about 150,000, and the fluorine content in the fluoro graft polymer is from about 10% by weight to about 30% by weight with respect to a weight of the fluoro graft polymer;

a developing unit that develops an electrostatic latent image formed on the electrophotographic photoreceptor by an electrostatic latent image developer to form a toner image;

a transfer unit that transfers the toner image formed on the electrophotographic photoreceptor to a transfer receiving body; and a fixing unit that fixes the toner image transferred to the transfer receiving body.

8. The image forming apparatus of claim 7, wherein the content of the fluoro graft polymer is from about 0.5% by weight to about 5.0% by weight based on the content of the fluorine containing resin particles.

9. The image forming apparatus of claim 7, wherein the fluoro graft polymer is a fluoroalkyl group-containing copolymer containing repeating units represented by the following structural formulae A and B:

Structural formula A

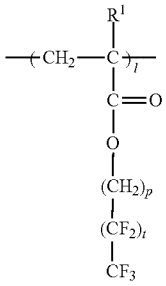

Structural formula B

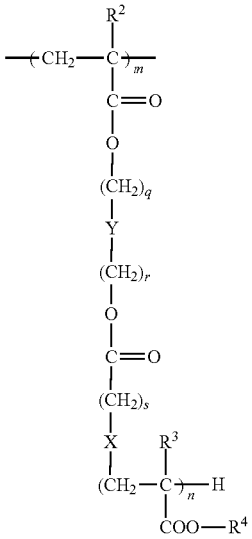

wherein l, m and n each independently represent a positive number of 1 or more;

p, q, r and s each independently represent 0 or a positive number of 1 or more;

t represents 0 or a positive number of 6 or less;

$R^1$, $R^2$, $R^3$ and $R^4$ each independently represent a hydrogen atom or an alkyl group;

X represents an alkylene group, a halogen-substituted alkylene group, —S—, —O—, —NH— or a single bond;

Y represents an alkylene group, a halogen-substituted alkylene group, —($C_zH_{2z-1}$(OH))— or a single bond; and z represents a positive number of 1 or more.

* * * * *